US007878250B2

(12) United States Patent
Sheldon

(10) Patent No.: US 7,878,250 B2
(45) Date of Patent: Feb. 1, 2011

(54) SYSTEM AND METHOD FOR AUTOMATING OR METERING FLUID RECOVERED AT A WELL

(75) Inventor: Michael L. Sheldon, Georgetown, TX (US)

(73) Assignee: Fisher-Rosemount Systems, Inc., Austin, TX (US)

( * ) Notice: Subject to any disclaimer, the term of this patent is extended or adjusted under 35 U.S.C. 154(b) by 0 days.

(21) Appl. No.: 11/232,567

(22) Filed: Sep. 22, 2005

(65) Prior Publication Data

US 2006/0032533 A1 Feb. 16, 2006

Related U.S. Application Data

(62) Division of application No. 10/440,609, filed on May 19, 2003, now abandoned.

(60) Provisional application No. 60/394,292, filed on Jul. 8, 2002, provisional application No. 60/446,169, filed on Feb. 10, 2003.

(51) Int. Cl.
*E21B 43/00* (2006.01)

(52) U.S. Cl. ..... 166/369; 166/372; 340/853.1; 702/45; 702/55

(58) Field of Classification Search ..... 166/369, 166/372; 340/853.1, 870.07, 870.11
See application file for complete search history.

(56) References Cited

U.S. PATENT DOCUMENTS

| | | | | |
|---|---|---|---|---|
| 1,603,675 | A | 10/1926 | Folsom et al. | |
| 2,180,864 | A | 11/1939 | Connor | |
| 3,392,580 | A | 7/1968 | Bain et al. | 73/215 |
| 3,578,077 | A | 5/1971 | Glenn, Jr. et al. | 166/68 |
| 3,887,008 | A | 6/1975 | Canfield | 166/267 |
| 4,102,394 | A | 7/1978 | Botts | 166/65 R |
| 4,149,237 | A | 4/1979 | Freitas | 364/107 |
| 4,152,760 | A | 5/1979 | Freitas et al. | 364/107 |
| 4,268,822 | A | 5/1981 | Olsen | 340/533 |
| 4,303,973 | A | 12/1981 | Williamson, Jr. et al. | 364/103 |
| 4,461,172 | A | 7/1984 | McKee et al. | 73/155 |
| 4,517,637 | A | 5/1985 | Cassell | 364/138 |
| 4,539,655 | A | 9/1985 | Trussell et al. | 364/900 |
| 4,726,017 | A | 2/1988 | Krum et al. | 370/85 |
| 4,729,091 | A | 3/1988 | Freeman et al. | 364/200 |

(Continued)

FOREIGN PATENT DOCUMENTS

| | | |
|---|---|---|
| EP | 0 491 657 | 12/1991 |

(Continued)

OTHER PUBLICATIONS

International Search Report in PCT/US03/20885 mailed Jun. 10, 2004 (7 pages).

(Continued)

*Primary Examiner*—Timothy Edwards, Jr.
(74) *Attorney, Agent, or Firm*—Marshall, Gerstein & Borun LLP

(57) ABSTRACT

Disclosed herein are methods, apparatus and systems for automating or metering fluid recovered at a well. According to one example, a system is described for automating the fluid recovery of oil wells using a pump jack or oil extractor. A communications device is installed with each system to allow remote bi-directional communications to monitor, control, and diagnose problems with the device or system.

16 Claims, 8 Drawing Sheets

U.S. PATENT DOCUMENTS

| | | | | |
|---|---|---|---|---|
| 4,854,164 | A | 8/1989 | Rhoads | 73/155 |
| 4,910,658 | A | 3/1990 | Dudash et al. | 364/138 |
| 4,916,441 | A | 4/1990 | Gombrich | 340/712 |
| 4,949,299 | A | 8/1990 | Pickett | 364/900 |
| 5,088,021 | A | 2/1992 | McLaughlin et al. | 364/187 |
| 5,099,444 | A | 3/1992 | Wilson et al. | 364/709.09 |
| 5,131,019 | A | 7/1992 | Sheffer et al. | 379/39 |
| 5,142,550 | A | 8/1992 | Tymes | 375/1 |
| 5,150,363 | A | 9/1992 | Mitchell | 370/112 |
| 5,239,662 | A | 8/1993 | Danielson et al. | 395/800 |
| 5,252,967 | A | 10/1993 | Brennan et al. | 340/870.02 |
| 5,307,297 | A | 4/1994 | Iguchi et al. | 364/708.1 |
| 5,374,231 | A | 12/1994 | Obrist | 483/15 |
| 5,400,246 | A | 3/1995 | Wilson et al. | 364/146 |
| 5,400,253 | A | 3/1995 | O'Connor | 364/442 |
| 5,451,923 | A | 9/1995 | Seberger et al. | 340/310.06 |
| 5,493,569 | A | 2/1996 | Buchholz et al. | 370/85.7 |
| 5,495,482 | A | 2/1996 | White et al. | 370/85.11 |
| 5,495,484 | A | 2/1996 | Self et al. | 370/110.1 |
| 5,517,593 | A * | 5/1996 | Nenniger et al. | 392/301 |
| 5,559,804 | A | 9/1996 | Amada et al. | 370/95.3 |
| 5,612,890 | A | 3/1997 | Strasser et al. | 364/479.11 |
| 5,657,317 | A | 8/1997 | Mahany et al. | 370/338 |
| 5,664,005 | A | 9/1997 | Emery et al. | 455/422 |
| 5,666,530 | A | 9/1997 | Clark et al. | 395/617 |
| 5,680,899 | A | 10/1997 | Waid et al. | 166/250.01 |
| 5,682,476 | A | 10/1997 | Tapperson et al. | 395/200.05 |
| 5,819,848 | A | 10/1998 | Rasmuson et al. | 166/250.15 |
| 5,823,262 | A | 10/1998 | Dutton | 166/250.15 |
| 5,845,230 | A * | 12/1998 | Lamberson | 702/56 |
| 5,963,650 | A * | 10/1999 | Simionescu et al. | 705/63 |
| 6,043,461 | A | 3/2000 | Holling et al. | 219/445.1 |
| 6,129,449 | A | 10/2000 | McCain et al. | 364/479.14 |
| 6,182,756 | B1 | 2/2001 | Garcia et al. | 166/250.15 |
| 6,236,334 | B1 | 5/2001 | Tapperson et al. | 340/825.37 |
| 6,460,622 | B1 * | 10/2002 | Rice | 166/369 |
| 6,463,389 | B1 * | 10/2002 | Dickson | 702/35 |
| 6,615,924 | B2 * | 9/2003 | Rice | 166/369 |
| 6,615,925 | B2 | 9/2003 | Rice | 166/369 |
| 6,851,444 | B1 * | 2/2005 | Kohl et al. | 137/13 |
| 6,899,178 | B2 * | 5/2005 | Tubel | 166/313 |
| 6,967,589 | B1 * | 11/2005 | Peters | 340/854.6 |
| 7,096,961 | B2 * | 8/2006 | Clark et al. | 166/380 |
| 2002/0013679 | A1 * | 1/2002 | Petite | 702/188 |
| 2002/0166662 | A1 | 11/2002 | Eggleston | 166/68 |
| 2002/0179303 | A1 * | 12/2002 | Maxit et al. | 166/369 |
| 2003/0043052 | A1 | 3/2003 | Tapperson et al. | 340/825.37 |
| 2003/0047308 | A1 * | 3/2003 | Hirsch et al. | 166/250.15 |
| 2004/0028023 | A1 * | 2/2004 | Mandhyan et al. | 370/351 |
| 2004/0149436 | A1 * | 8/2004 | Sheldon | 166/250.15 |
| 2005/0047330 | A1 | 3/2005 | Tapperson et al. | 370/225 |
| 2005/0047331 | A1 | 3/2005 | Tapperson et al. | 370/225 |
| 2005/0049727 | A1 | 3/2005 | Tapperson et al. | 700/19 |
| 2005/0076151 | A1 | 4/2005 | Tapperson et al. | 709/249 |

FOREIGN PATENT DOCUMENTS

| | | |
|---|---|---|
| GB | 2 283 836 | 5/1995 |
| JP | 61-136341 | 6/1986 |
| JP | 04-307608 | 10/1992 |
| JP | 05-252564 | 9/1993 |
| JP | 11-514065 | 11/1999 |
| NZ | 216109 | 8/1989 |
| NZ | 227231 | 1/1991 |
| NZ | 239534 | 11/1993 |
| WO | WO-97/38207 | 10/1997 |

OTHER PUBLICATIONS

Written Opinion issued in PCT/US03/20885 application mailed Mar. 11, 2005 (5 pages).

Supplementary Partial Search Report in counterpart EP 03763128. 0-2315, mailed Nov. 10, 2005 (4 pages).

International Preliminary Examination Report in PCT/US03/20885 mailed Jan. 5, 2006 (6 pages).

Roberts, "OLCHFA" a Distribution Time-Critical Fieldbus, IEE, UK, London, Digest No. 1993/189, Oct. 1993, pp. 6/1-6/2.

"The Fisher ROC364," Fisher Controls International, Inc., 2 pages, Jul. 1996.

"FloBoss 500 Flow Manager," Fisher Controls International, Inc., 2 pages, Sep. 1996.

"The Fisher ROC306 and ROC312," Fisher Controls International, Inc., 2 pages, Jun. 1997.

"Cellular Digital Packet Data Reduces SCADA Costs," reprinted from the American Oil and Gas Reported, Aug. 1997, 4 pages.

Notice of Rejection for Japanese Application No. 2004-519796, dated Jan. 20, 2009.

Official Action issued Mar. 27, 2009 by the European Patent Office for European Application No. 03 763 128.0-2315.

* cited by examiner

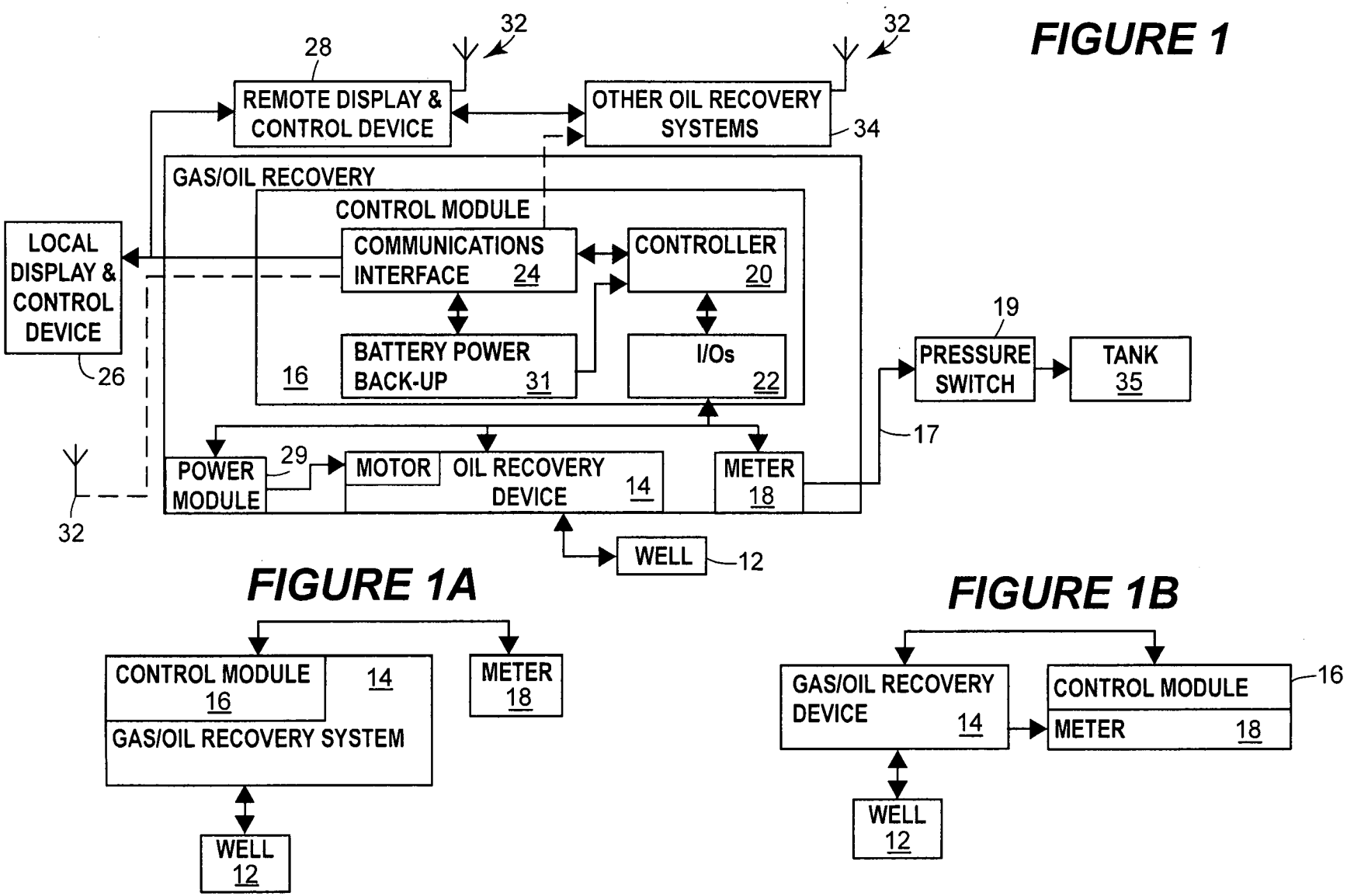
FIGURE 1
FIGURE 1B
FIGURE 1A
TANK 35
PRESSURE SWITCH
19
17
32
34
OTHER OIL RECOVERY SYSTEMS
REMOTE DISPLAY & CONTROL DEVICE
28
GAS/OIL RECOVERY
CONTROL MODULE
CONTROLLER 20
I/Os 22
COMMUNICATIONS INTERFACE 24
BATTERY POWER BACK-UP 31
16
METER 18
OIL RECOVERY DEVICE 14
MOTOR
POWER MODULE
29
WELL
12
LOCAL DISPLAY & CONTROL DEVICE
26
CONTROL MODULE
METER 18
GAS/OIL RECOVERY DEVICE 14
WELL 12
CONTROL MODULE 16
METER 18
GAS/OIL RECOVERY SYSTEM
14
WELL 12

SYSTEM AND METHOD FOR AUTOMATING OR METERING FLUID RECOVERED AT A WELL

CROSS-REFERENCE TO RELATED APPLICATION

This application is a divisional application of and claims priority under 35 U.S.C. §120 to U.S. patent application Ser. No. 10/440,609, entitled "System and Method for Automating or Metering Fluid Recovered at a Well," filed on May 19, 2003, which claims priority from U.S. Provisional Application Ser. No. 60/394,292 filed on Jul. 8, 2002, and from U.S. Provisional Application Ser. No. 60/446,169 filed on Feb. 10, 2003, each entitled "System and Method for Automating or Metering Fluid Recovered at a Well," the entire disclosures of each which are hereby expressly incorporated by reference herein.

FIELD OF THE INVENTION

The present system and method relates to an automatic fluid recovery system, particularly for recovery systems used for recovering oil and gas from wells. The system at the well may be monitored and controlled locally or remotely. The amount of fluid recovered at a well is metered at the well

BACKGROUND

Wells such as oil and gas wells are often located in remote locations. Recovery devices such as pump jack are used to recover oil from the well and pump it to a storage tank. Typically, the tank is connected to several wells by pipelines/flow lines that are interconnected together. In the case of oil fields where water is often pumped with the oil, separator tanks are used to separate the oil from the water. The oil collected is then sold to refineries. Operation of these field devices is typically by connecting the device to a local power supply and then turning on the motor. Maintenance requires visiting the site and viewing the operation of the device. If problems occur at the well or if adjustments are necessary after the scheduled maintenance visit, it will have to wait until the next visit to be discovered and corrected. Generally, determining the amount of oil or gas produced at a well is done by measuring the level of oil or gas in the collection tank. If there is more than one well feeding the tank, determining the amount of oil or gas retrieved by any individual well is problematic

BRIEF DESCRIPTION OF THE DRAWINGS

The foregoing and other objects and advantages of the invention will become clearer with reference to the following detailed description as illustrated by the drawings in which:

FIG. 1 is a schematic diagram of a recovery system having a control module for automating the recovery of fluid from a well by a recovery device and for measuring the amount of fluid recovered at that well by a meter.

FIG. 1A is a schematic diagram of the recovery system of FIG. 1 alternatively illustrating the control module as an integrated part of the recovery device.

FIG. 1B is a schematic diagram of the oil recovery system of FIG. 1 alternatively illustrating the control module as an integrated part of the meter.

DETAIL DESCRIPTION OF THE DISCLOSURE

Figure 2A:
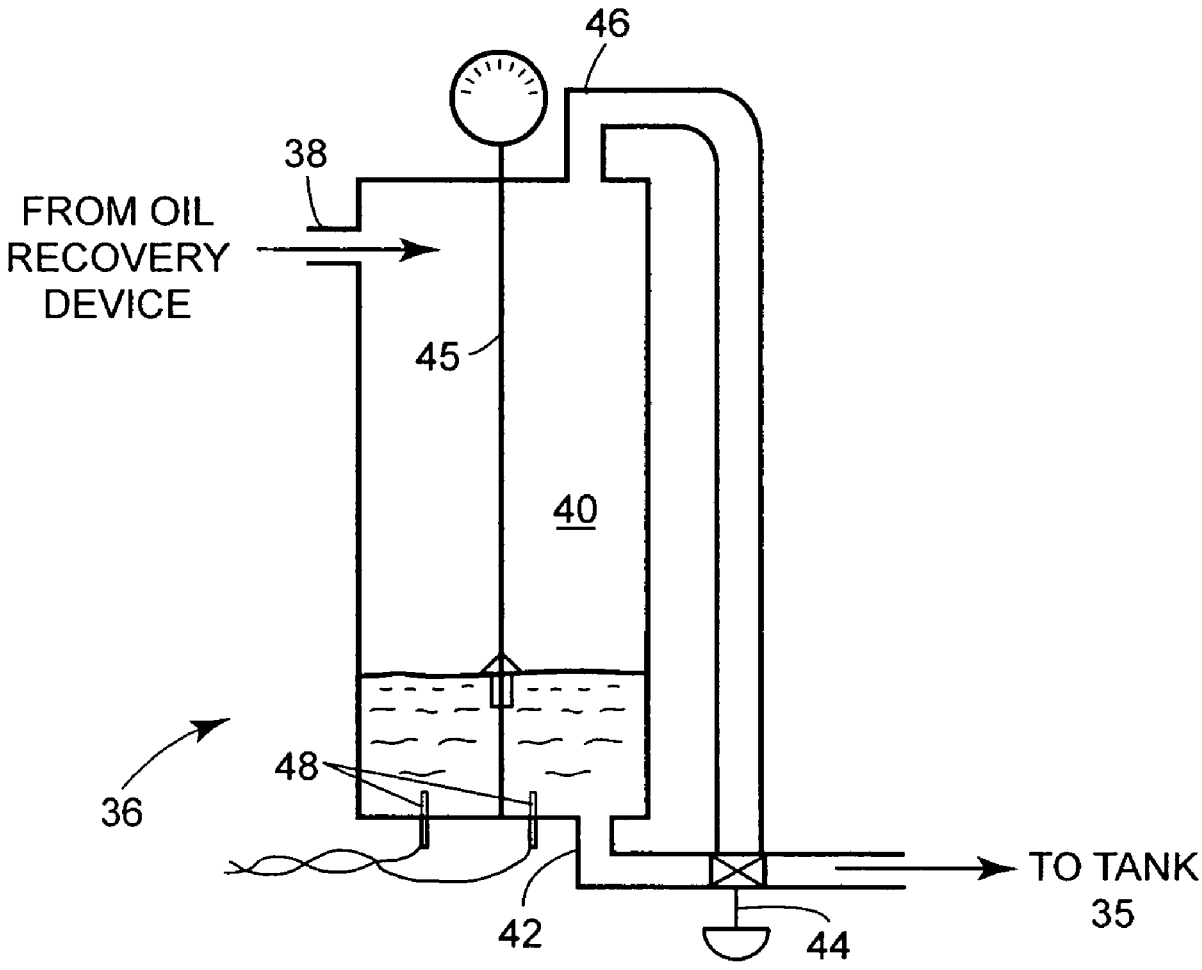
FIG. 2A is a schematic diagram of a tank meter used to measure fluid recovered by the recovery device.

The present disclosure provides a way of automating the fluid recovery process at a well and because the system described below is relatively inexpensive, it is particularly useful at low margin oil wells known as stripper wells. Stripper wells are low tier, low producing wells often yielding up to 5 barrels of oil a day. By automating the recovery process at each well, other benefits can be realized. For example, as will be discussed in more detail below, one benefit is the ability to automatically discover the recovery rate of oil in the well and tune the recovery of oil at that rate. This would significantly reduce the cost of oil recovery, both in expense to operate the recovery device and maintenance to keep it operating. Another benefit is the ability to precisely measure the amount of oil recovered at each well. Each well has its own recovery characteristic. By metering the amount of oil recovered at each well a history of recovery can be developed for forecasting future oil recovery from that well. Diagnostics of the various components or the system as a whole may also be used to determine problems with the recovery process. Similarly, metering fluid at each well will also provide the opportunity to monitor the status of the entire oil field, including the recovery device, lines used to pump fluid to storage tanks, and the tanks themselves.

Displaying, monitoring, and controlling the automated recovery system can be done locally at the well or remotely using a desktop or laptop computer. Communicating with the recovery system can include two-wire, wireless technology, or other currently available communication technology. Protocols such as the HART, Fieldbus, Modbus, or other protocols could be used. Further, as will be described in greater detail below, several automated recovery systems can be networked together to monitor and control several wells in a field or the entire field recovery system from one location. While an oil recovery system is described below, it should be understood and appreciated by one skilled in the art that the teachings of the present disclosure could be applied to other types of wells, such as water and gas wells.

Oil Recovery System

Referring now to FIG. 1, a system 10 for automating oil recovery and for metering the amount of oil recovered at a well 12 is illustrated. As shown, an oil recovery system 11 of the present invention includes an oil recovery device 14, a control module 16, and a meter 18. The oil recovery device 14 can be any one of several types of devices such as a bailing or an air jetting device, which are known oil recovery devices in the oil recovery business. The concepts of the present invention, however, are particularly beneficial when using the commonly used pump jack or the newly marketed oil extractor by Texas Heritage Oil, Inc. of Georgetown, Tex. to pump fluid to a storage tank 35. To fully appreciate the benefits of this invention, the oil recovery system described below will include the oil extractor and a pump jack as examples of oil recovery devices to better describe the present invention. It should also be appreciated that the control module could be a stand alone module connected to the oil recovery device and/or meter as illustrated by FIG. 1A, fully integrated into the electronics of the recovery device, or fully integrated into the electronics of the meter as illustrated in FIG. 1B. Similarly, the oil recovery system could be built without a meter. In other words, the system could just be comprised of a pump jack or an oil extractor device and a control module.

Oil Recovery Device

The oil extractor currently marketed by Texas Heritage Oil, Inc. includes a canister, which is raised and lowered into the well by a base unit. Generally, the depth of the canister placed down in the well is predetermined by tests to determine the top of the oil standing in the well and the oil/water interface level. Based on this information the depth setting of the canister is determined. The canister may include a pump and a container for collecting the oil. A battery source may also be located in the canister to power the pump. When the canister is brought to the surface it interfaces with a discharge head. As it interfaces the discharge head, a limit switch is activated to stop the motor (used to bring the canister to the surface) and to start a compressor (used to pressurize the canister and force the oil up through a tube and out the discharge head). Limit switches are also used to control the depth of the canister in the well so that it collects only oil. Typically the compressor is timed so that it runs for a period of time (generally two or three minutes) that is long enough to drain the oil recovered in the canister to a meter, to a flow line and/or to an external collection tank. A separate timer may also be set to time the recharging of the battery in the canister before it begins the next cycle of oil recovery. Timers are also used to limit or control the down cycle time (the total time to lower the canister into the well plus the time it is left in the well to pump oil in the canister) as well as the up cycle time, which is the time used to raise the canister plus the time for charging the battery.

Setting the down and up cycles controls the number of recovery cycles and hence the amount of oil recovered by the oil extractor. For example, setting a down cycle for one hour and an up cycle for two hours means that the oil extractor will make eight oil recovery cycles in a twenty-four hour period. In other words, timers are used to determine the amount of time the canister sits in the oil in the well to allow it to fill and then the amount of time it sits at the surface before it returns to collect another load. If the canister holds four and one-half gallons, then thirty-six gallons of oil will be recovered over a twenty-four hour period. This assumes that the canister is sufficiently placed in the pool of oil in the well so that the canister fills completely before it is brought to the surface.

A more detail description of the oil extractor is shown and described in U.S. patent application having the Ser. No. 10/106,655 entitled "An Apparatus for Extracting Oil or Other Fluids From a Well" by Philip Eggleston and filed on Mar. 26, 2002 and hereby incorporated by reference.

The pump jack has been used to pump oil from wells for a number of years. Examples of these types of pumps are disclosed in U.S. Pat. Nos. 1,603,675 and 2,180,864 and are hereby incorporated by reference. Typically a pump is placed down in the well and is connected to a series of rods and tubing. The interconnected rods, which are used to actuate the pump, are linked to the familiar rocker arms seen in the oil fields moving up and down. An electrical motor is used to drive the rocker arm and hence the pump using the rods. The pump sends fluid up the long interconnected series of tubes to the surface and then to a collection tank. The common rule of thumb in the industry is to place the pump sixty feet (typically two sections of pipes and rods) from the bottom of the well. A common problem with this rule is that the pump is almost always placed in salt water, which often exists in oil wells. As a result, salt water is pumped with the oil. Because of this problem, separator tanks are almost always provided on the surface to separate oil from the water. Salt water is very corrosive and is one of the major causes for pumps breaking down. To avail pumping salt water, a test can first be conducted to determine the top of oil in the well and then the level of the oil/water interface. Once this is determined, the pump can be placed at a depth where only oil is pumped from the well.

Control Module

In the preferred embodiment, the control module 16 consists of a microprocessor-based controller 20 that provides the functions required for a variety of field automation applications that would enable local or remote monitoring, measurement and data archival, and control of the oil recovery device. For example a Programmable Logic Controller (commonly known as a PLC) could be used. One relatively inexpensive and currently available PLC is provided by Unitronics Industrial Automations Systems. Unitronics' PLC is has a sufficient processing ability, number of timers, memory, to control an oil recovery device and has the ability to provide bi-directional communications. Other controllers are also available and could be adapted for use in the present application. Such devices also include sufficient process inputs and outputs (I/Os) 22 for connecting the controller to the various electrical components of the oil recovery device. The benefit of multiple I/Os is that it enables the module to connect to various devices for collecting measured and sensed data for controlling or diagnosing the operation of the oil recovery system. In other words, the control module is used to automate the recovery system and allow for remote communication and control of the operation of the recovery system. For example the extractor unit uses a spool assembly to raise and lower a canister to collect oil in the well. Preferably a proximity sensor is used to monitor the rotation of the spool to measure and control the depth of the canister. Further, the limit switches, used to detect when the canister has been seated properly into the discharge head, are detected by the control module and are used to control both the motor and the compressor to pump the oil out of the canister. Timers within the control module (commonly provided with most PLCs) can also control the various aspects of the cycle, i.e. when and how long to run the compressor, how long to keep the canister at the top of the well before sending it down the well for another load, how long to keep the canister at a pre-selected depth to collect oil, etc. The control module also has the ability to tune the recovery process for optimal recovery as will be discussed below.

Similarly, the control module can be used to automate the recovery system when a pump jack is used as the oil recovery device. As mentioned above, pump jack recovery devices often use electric motors to drive a rocker arm up and down. The rocker arm in turn is connected to the rods used to drive the pump in the well. A belt and pulley assembly typically connects the motor to the rocker arms. Often the belt wears and breaks without notice and is not discovered until a routine maintenance visit to the well site. To help automate, control, detect, and diagnose problems with the pump jack, I/Os of the control module are preferably connected to various electrical devices to control and monitor the pump jack and the recovery system. For example, a proximity sensor (not shown) is preferably used to measure the motion of one of the pulleys of the pulley assembly to detect whether the belt(s) have broken or are slipping to the point that the flywheel is not transferring power from the motor to the rocker arm. Further, a power module 19 (FIG. 1), such as that sold by CR Magnetics in Fenton, Mo., is preferably used to determine motor load. Determining motor load is important for several reasons. One is the health of the motor itself. Another is the health of the pump and rods. For example, if the pump or rods break, the motor load will significantly drop and can be detected by the control module. A drop in motor load could also be symptomatic of other problems as would be recognized by one skilled in the art. For instance, when the well has been pumped dry, the load on the pump should also drop. It is also preferred that I/O of the control module be connected to the motor for controlling the operation of the motor and the meter. Connections to other devices to control and monitor pup jacks should become apparent in light of this disclosure.

It is also preferred that the control module 16 have a communications interface 24 that would allow the module to bi-directionally communicate with a local or remote display and control device (26,28), i.e. a laptop or desk computer. Interconnection can be accomplished by either direct wiring 30 or through some form of wireless communication 32 such as cellular technology or radio technology. In some cases it may be practical, depending on the application and as will be described below, to have both cellular and radio technology incorporated in the module. This may further enable other remotely located oil recovery systems 34 to be linked together. This will be discussed in greater detail below. A battery back up 31 is also preferably provided to power the module, in the case of a power outage. A relay switch (not shown) could be placed in the main power line and used to monitor or detect power outages by the control module, which could then report this condition to a remote user. Using this information, time and money can be saved by allocating resources to wells that need attention.

In addition to monitoring and controlling the oil recovery device, the control module has the ability to do diagnostics on the operation of the oil recovery device and system as a whole. For example, preferably a pressure sensor 19 is provided and in the flow path to measure the pressure in the flow line 17 to the collection tank 35. Using the control module to detect the pressure in the flow line and terminate the pumping process can prevent pumping into lines that are clogged because of paraffin build up or into lines that have below normal pressure indicating that there may be leaks in the flow line. For detecting over pressure line conditions, commonly available pressure switches can be wired and set for detection by the control module. Information resulting from any diagnostics determined by the control module can then be transmitted to a remote user.

The logic used to program controllers is typically straightforward. For example, most PLCs are programmed using ladder logic, which is a commonly known programming language. Other commonly used programming languages may also be employed. After understanding the applications disclosed herein and depending on the control, diagnostics, collected data, communications, etc. that may be preferred, one skilled in the art should be able to easily program the desired logic into the controller. An illustrative example of the type of control that is preferred will be discussed in greater detail below.

Meter

For reasons that will become clear, using a meter 18 to measure the amount of oil recovered at the well by the recovery device is an important, but not necessarily a required part of automating the system for recovery. One benefit of measuring the amount of oil recovered at a well is that the amount of oil recovered can be used to tune the recovery device to maximize the recovery at that well. Another benefit is the ability to track the production and history of production at a particular well.

The type of meter used in the present invention will greatly depend on the application of the oil recovery system. For example, if the oil recovery device is a pump jack then there will likely be continuous flow of fluid pumped from the well. Since the pump is preferably placed only in oil, a Coriolis flow meter may be more practical than other types of meters for measuring the amount of oil pumped from the well. A Coriolis flow meter is generally available through a variety of venders. One such vendor, for example, is Micro Motion located in Boulder, Colo. Other types of flow meters are widely available, such as ultrasonic flow meters, vortex flow meters, etc., and may also be used. Depending on the meter used, preferably (although not required) it is configured so that only oil is metered. Measuring and monitoring fluid flow, even if it includes a combination of oil and water may be important. For example, to maintain the health of the pump, it is important to determine if it is still pumping fluid. If the pump is left on after it has pumped the well dry, it is likely that the pump will be damaged. Once the history of the well is known, a timer is preferably used to control the cycles of when the pump should be turned on and off to efficiently pump fluid from the well as will be discussed below.

Even though the goal is to pump only oil, determining just the right depth to place the pump is not an exact science. For example, water tables can change over time. Thus the ability of the controller to test for the presence of water is useful information and can be used as a signal to turn off the motor of the pump jack. Depending on which meter that is used; the presence of water may need to be detected separately. A separate sensor can be as simple as a set of probes placed in the flow stream to detect the conductivity of the fluid. For example, if water crosses the two probes, a connection is made to indicate that water is being pumped. Otherwise, air or oil in the line will electrically insulate the probes.

If, however, an oil extractor were used, then the oil recovered would be in cycles or small batches of "oil slugs" flowing in an airline. Measuring these smaller amounts of oil for each cycle is more difficult, but nonetheless important information for automating the oil extractor as will be discussed below. A Coriolis meter could be similarly used to measure the slugs of oil, but because of the cost of the meter, it may not be practical. Similarly, other meters as discussed above are available and could be used.

As an alternative, a special tank meter 36 shown in FIG. 2A that is under the control of the control module could be used. Because pressurized air is used to pump oil out of the canister, the oil needs to be separated from the air before it can be measured. As shown, oil pushed by compressed air flows out the discharge head and through an inlet 38 located near the top of a tank 40 (having a known volume) when the canister reaches the surface. An outlet 42 for draining the oil from the tank 40 is located at the bottom and is closed by a three-way valve 44, while the oil fills the tank 40. The three-way valve 44 is preferably a solenoid valve controlled by the control module 16 (FIG. 1). A vent 46 is located at the top of the tank 40 and is connected to the three-way valve 44 to allow the pressurized air to be exhausted, while the tank 40 is being filled with oil. As the oil slug is being dumped into the tank, a float level meter 45, connected to the control module 16, detects the level of the oil. The float meter 45 is preferably similar to float meters used to determine the level of gasoline in an automobile's gas tank. One skilled in the art would appreciate that other types of level indicators could also be used. In the preferred embodiment, the meter is a resistive type that varies in ohms as the level of oil rises in the tank. Using the level of the oil in the tank (in combination with the known volume of the tank), the control module 16 can easily determine the amount of oil recovered during that recovery cycle. Sensor probes 48 connected to the control module are also placed at the bottom of the tank 40 to detect the presence of water. After determining the amount of oil recovered during that cycle, the oil is drained from the tank 40 by switching the three-way valve 44 to open the drain and close the vent 46. The tank 40 can either be re-pressurized by the compressor or pumped out using an external pump (not shown) to pump the fluid to the storage tank 35. Other configurations of the tank meter 36 are possible to accomplish the oil/air separation and measurement, as would be appreciated by one skilled in the art.

Another method for measuring the fluid in the canister is to use the control module to automatically pressurize the canister to a predetermined pressure after each recovery cycle before it is emptied and then measure the amount of time required to reach that predetermined pressure. The amount of time it takes to pressurize the canister to that predetermined pressure has been found to be directly proportional to the amount of fluid in the canister. In other words, referring to FIG. 2B, a canister 51, under the control of the control module 16, is brought to the surface and engages with the discharge head 49. After engagement, it is pressurized using a compressor 53. Depending on the desired compressor used by the recovery system, the compressor 53 can be directly controlled by the control module 16 or through a solenoid 55, as shown, connecting a volume of compressed air stored in a pressure tank 57. A valve 59, also under the control of the control module, is preferably used to seal the canister 51 to allow it to be pressurized to the predetermined pressure to measure the volume of fluid in it. Alternatively, a pressure restrictor (not shown) could be use to pressurize the canister so that a timed measurement could be made. Preferably a pressure switch 61 set at a predetermined pressure is used to indicate when the predetermined pressure in the canister has been reached. For example, the pressure switch 61 could be set for 28 PSI. When the predetermined pressure is reached, i.e. 28 PSI in this example, the time it takes to reach that pressure is measured and used by the control module 16 to determine the fluid volume in the canister 51. Once the measurement is made, the valve 59 opens and allows the fluid to be pumped from the bottom of the canister 51, up through a tube 63, along the inside of the canister 51, and out into a flow line 65. This method of measuring fluid in the canister provides a cost effective and least disruptive method to the recovery process. This technique and method for measuring volume fluid using pressure is more fully shown and described in a provisional application filed by Michael Sheldon on Feb. 10, 2003 and having the title "Measuring Fluid Volumes in a Container using Pressure." The teachings of this application are hereby incorporated by reference herein.

Figure 2B:
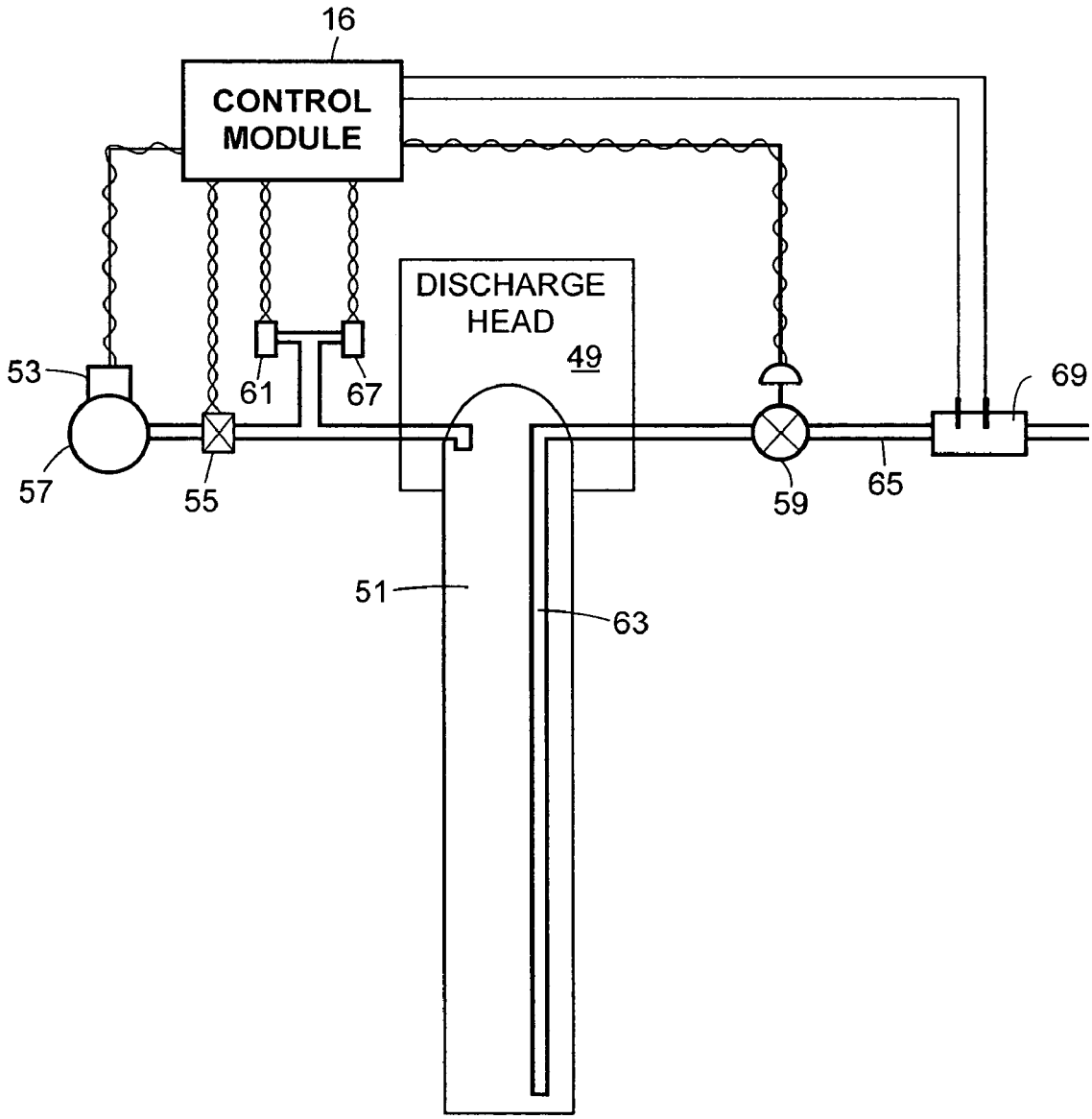
FIG. 2B is a schematic of an alternative metering system for an oil extractor.

As previously mentioned, a second pressure switch 67 may be provided and set to a predetermined higher pressure, for example 60 PSI to indicated if the line pressure is approximately equal to or higher than the second pressure switch setting. Higher pressures in the flow line may indicate that the flow line is clogged. In the alternative, a generally more expensive pressure sensor for measuring various pressure ranges could be used in place of the pressure switches. Using a pressure sensor, low pressures could be further detected in the flow line, which could indicate that there is flow line leak. Preferably, the second pressure switch is located as close to the flow line as practically possible for more accurate pressure readings. As one skilled in the art would appreciate, the flow line pressure switch shown in FIG. 2B is located in an air supply line to insulate it from the harsher flow line environment. As shown, the pressure of this switch will be slightly higher than the actual flow line because of the extra pressure necessary to push the fluid up and out of the canister.

Figure 2C:
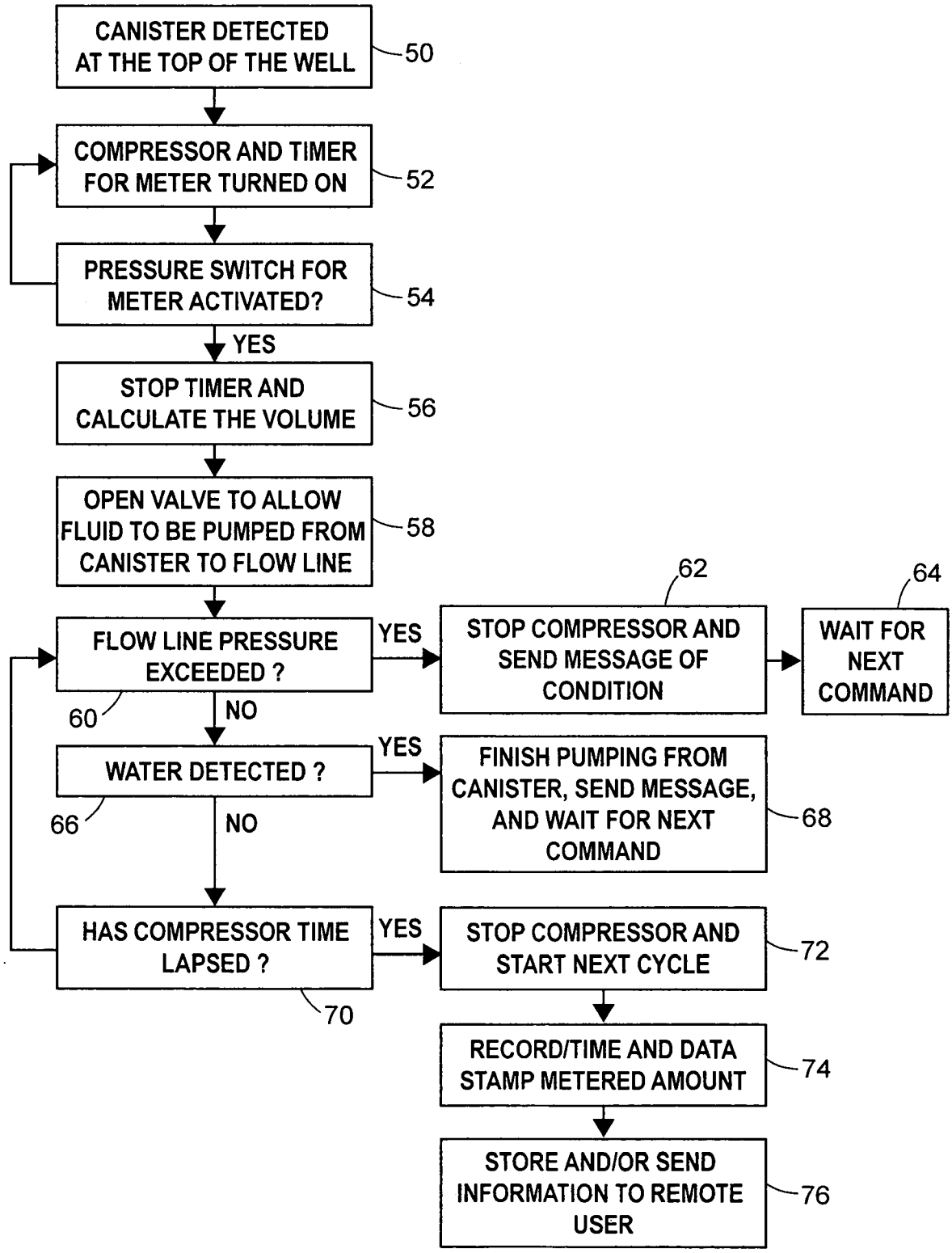
FIG. 2C is a flow diagram example illustrating automatic control of a control module for automatically metering the volume of fluid recovered by an oil extractor.

A flow diagram is shown in FIG. 2C and used to illustrate the steps that could be used by the control module for determining the volume of fluid in the canister and for detecting if water has been retrieved from the well using the above metering and pressure detection method. The cycle begins when the canister is first detected at the top of the well and properly engaged with the discharge head, step 50. With the canister seated at the top of the well, the compressor and a timer are turned on, step 52 and stay on until the pressure switch is activated, step 54. Once the pressure switch is activated, indicating that the predetermined pressure has been reached, the timer is stopped and the amount of time needed to reach that predetermined pressure is used to determine the amount of fluid in the canister, step 56. The valve to the flow line is then opened and fluid is pumped from the canister, step 58. A timer generally controls the amount of time the compressor runs to pump fluid from the canister. Depending on the type and size of the compressor, as well as the amount of back-pressure that may be present in the flow line, that time may vary. Typically, only a couple of minutes are all that is necessary to pump the canister out to the flow line. Once the time for running the compressor has lapsed, the control module turns off the compressor and closes the output valve. While the compressor is pumping the fluid from the canister into the flow line, the control module determines if over pressure or high flow line pressure exits, step 60, monitors the second pressure switch. If it is determined that the flow line pressure is too high, the compressor is stopped and a message is sent indicating the condition, step 62. The recovery device will then wait for instructions, step 64.

Further, as fluid is pumped from the canister, preferably sensors 69 (FIG. 2B), which may be conductive probes, are placed in the flow line and are used to detect if water is present in the canister load, step 66. If water is detected, the control module finishes pumping the contents of the canister into the flow line and then sends a message regarding this condition. Until instructions are sent back to the control module, the recovery devices sits idol, step 68

If neither of the above two conditions exist, the module will wait until the compressor has timed out before starting the next recovery cycle, steps 70 and 72. Thereafter, a record of the volume of fluid recovered, including the time and date when it was retrieved is created and set to a remote operator, steps 74 and 76. Alternatively, this record could be stored by the control module and retrieved by the operator or remote user if requested. Similarly this information, as well as various conditions and states of operation of the recovery device, can be displayed on a display panel of the control module (not shown) at the well site.

Oil Recovery System

Automatic control of the oil recovery system is accomplished by connecting the control module to the motor and the various switches to operate and control the oil recovery device as well as the meter. The actual connections to the various switches are not shown because they will depend on the particular oil recovery device and the various aspects of the control device that the user wishes to operate and monitor. But in view of the discussions for control herein, one skilled in the art should easily understand how to make such electrical connections to monitor and control the various actions of the oil recovery system.

Figure 3A:
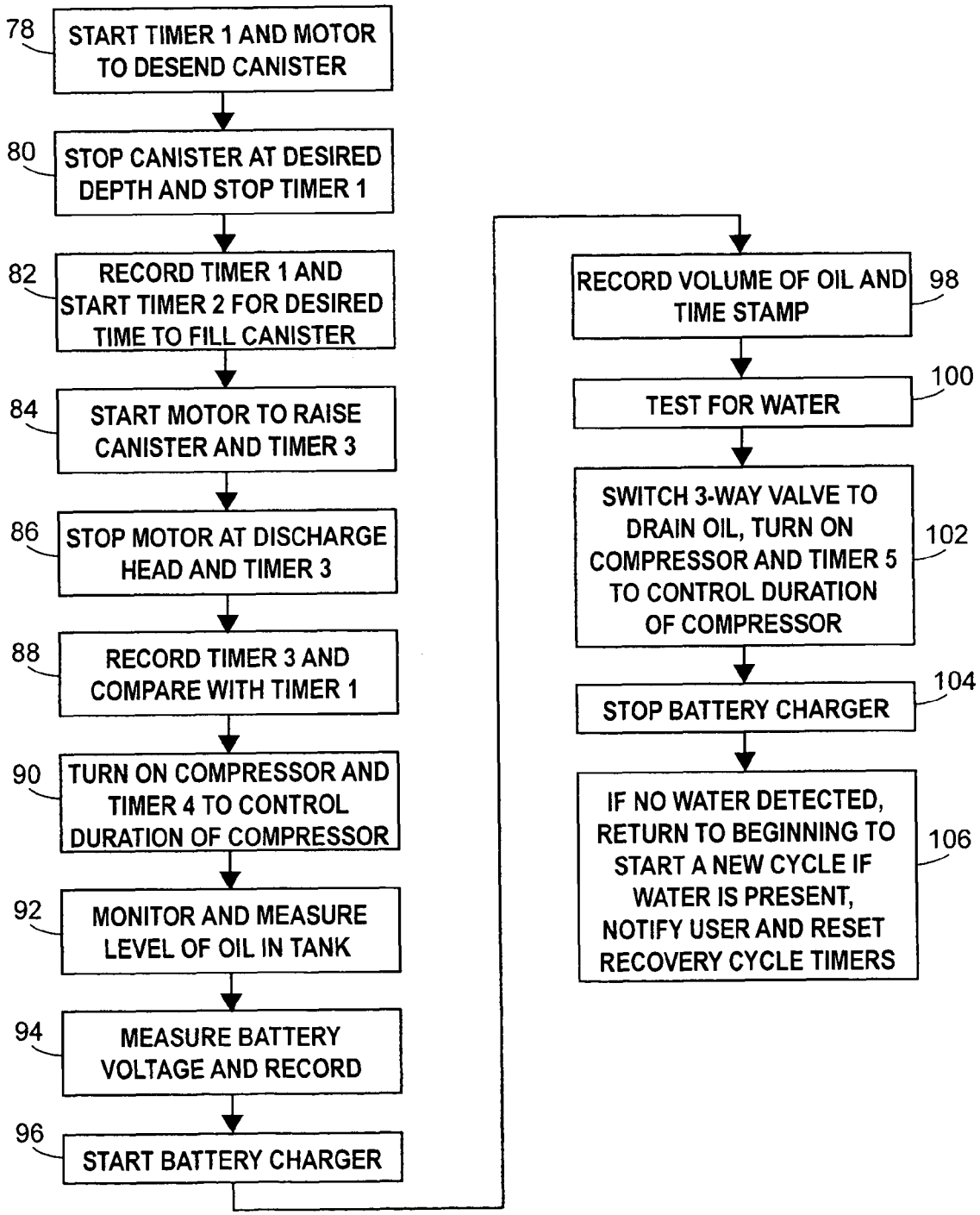
FIG. 3A is a flow diagram example illustrating control by the control module for automating a recovery cycle.

Referring now FIG. 3A a flow diagram is shown and used to illustrate a control cycle of the oil recovery system using an oil extractor. While the description below describes the preferred method for controlling the operations of such an oil recovery system, it should be appreciated by those skilled in that art that other methods and routines could be used to essentially accomplish the same or similar automated control.

As mentioned above the depth of the canister is predetermined and a relay switch is set before the canister is sent down into the well. To initiate the recovery cycle, the control module starts the motor to lower the canister down into the well and starts timer 1 to measure the time required to get to the desired depth, step 78. As one alternative, the timer could be used to control the motor, if the rate of the descent is known. Using the timer to control the motor would enable the user to easily change the depth of the canister without resetting the relay limit switch. That limit switch could then be used as a back up maximum depth switch, should something go wrong. The actual depth could also be detected by using a sensor, such as a proximity sensor that detects the revolution of a pulley used to lower the cable/canister down the well. In other words, the length of cable used could be metered. When the preferred depth is reached, the control module automatically turns off the motor.

At the desired depth, timer 1 is turned off and the amount of time it took for the canister to reach that depth is recorded by the control module 16, step 80. This information may be used later as diagnostic information to determine if problems existed with the canister descending down into the well. When the canister reaches the desired depth, timer 2 is started to control the time that the canister will stay in the well, step 82. Typically 3 or 4 minutes is all that is needed. When that timer times out or when that timed cycle is completed, the control module activates the motor to bring the canister back to the surface. Timer 3 is initiated to measure the required time to bring the canister back up to the surface, step 84. A relay switch (as described above) is used to detect when the canister interfaces with the discharge head. At that time the motor is turned off and the amount of time indicated by timer 3 is recorded, step 88. The time recorded for timer 1 and timer 3 can then be compared to see if there are any abnormalities or problems. At that time, the control module also activates the compressor, which pressurizes the canister and causes the oil to pump up and out of the discharge head of the extractor device. From the discharge head, the oil dumps into the tank meter as described above, step 90. Timer 4 is activated to control the time that the compressor is on. Typically 1 or 2 minutes is all that is required to pump the oil from the canister into the tank meter. While the oil is emptying into the tank, it is preferred that the control module constantly monitors the oil level in the tank, step 92. The canister has been emptied when the oil level ceases to rise. The compressor could be optionally turned off by the control module or left to run for its timed compressor cycle determined by timer 4. The control module may also measure the voltage of the battery while the canister is connected to the discharge head. A history of voltage measurements for every cycle could be stored and evaluated to determine the health or condition of the battery and/or it remaining battery life. Preferably the battery charger starts to recharge the battery while the canister is in the discharge head during each cycle, steps 94 and 96.

Once all the oil has been dumped into the tank, the volume is determined, recorded and time stamped, step 98. A test is also conducted to see if any water was dumped in the tank, step 100. These results are preferably recorded and time stamped. The three-way valve 44 (FIG. 2A) is then opened to drain the oil from the tank, preferably using pressurized air from the compressor. Using timer 5 the duration of the pressurized air needed to empty the tank can be controlled, step 102. If no water was found in the tank, the control module turns off the battery charger and returns to the beginning of the recovery cycle steps 104 and 106. If water is detected the control module notifies the user/operator and terminates the recovery cycle until the user reinitiates it and/or optionally automatically resets the recovery device to recover oil at a rate approximately equal to the oil being recovered by the well. This will be discussed in more detail below.

While the above describes different timers for different events, it should be understood by one skilled in the art that the same timer could be used for different purposes. Also, depending on the user, other control or monitoring features could be built into and/or currently shown operations removed from the operating flow diagram described above. For example, ambient temperature and/or pressure used to pump the oil could be measured.

Figure 3B:
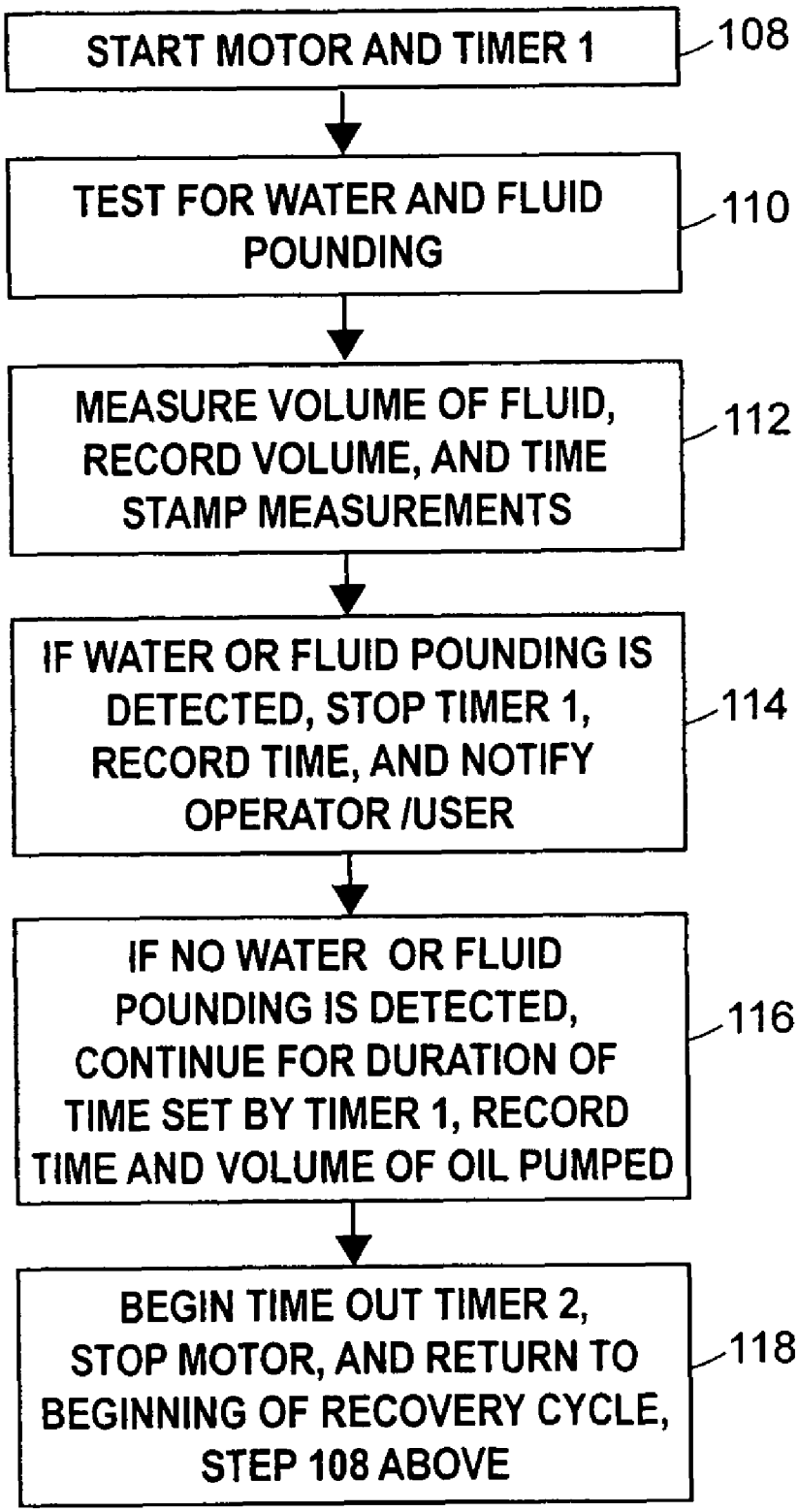
FIG. 3B is a flow diagram of another example illustrating control by the control module for automating a recovery cycle for a pump jack.

For a pump jack, the control module would not have to monitor and control all of the switches and timers that are necessary for the oil extractor. Generally, monitoring and controlling the oil recovery system would be a simpler matter. For example, as illustrated in FIG. 3B, the recovery cycle begins with the control module turning on the motor, causing fluid to be pumped to the meter where the volume of oil is measured, recorded and time stamped, step 108. A timer 1 is started to measure/control the duration of the recovery cycle. Since it is preferred that the pump is placed at a much higher level in the well to preferably pump only oil, the duration that the pump would run would be a function of the amount of oil that has accumulated in the well since the last time it was pumped and the well's oil recovery rate. This will be discussed in greater detail below. As it is pumped, the fluid is tested for the presence of water or "fluid pounding," step 110. Because of the possibility of changing water tables, or selecting the proper depth for placing the pump, it is always possible that water could be pumped. Fluid pounding occurs when the level of fluid to be pumped is less than the amount of fluid that can be readily handled by the pumping equipment, which could result in damaging the pump. Fluid pounding could be easily determined by measuring the motor load, which will be different for pumping fluid than for pumping air. If water or fluid pounding is detected then the control module could turn the motor off, stop timer 1, record the pumped time, and then notify the user. Timer 1 may then need to be reset to a new pump time cycle steps 112 and 114. Otherwise the pump continues its operation until the recovery cycle timer 1 clocks out, step 116. Once that occurs, the controller stops the motor and begins a time out timer 2 set to the recovery rate of the well. At the end of that time out, the recovery cycle begins a new cycle. In other words, the pump jack could be turned on by the control module for 20 minutes and then turned off for the remainder of the day as an example, depending on the well's oil recovery rate, step 118.

Tuning

In order to efficiently pump oil from a well it is useful to determine the recovery rate of the oil seeping into the well, i.e. oil recovery rate of the well. Generally, the expected rate of oil recovery for any particular well can be determined from the pumping history of the well. That rate is often determined by the amount of oil recovered using old pumping techniques that include pumping water, so it is not necessarily reliable information. Further, water tables change over time. As a result, the amount of oil seeping into the well can change. Still further, since it is preferred that the pump is placed in the well so that only oil is pumped, there is less hydrostatic pressure in the well used to pull oil into the well, so the amount of oil available to pump could change. As a result, the best way to measure that recovery rate is to place the pump for both the oil extractor and the pump jack at predetermined depth in the well and set the recovery device to recover oil faster than the expected rate of oil recovery. For the oil extractor this means that for each recovery cycle the canister would return to the same depth in the well. Preferably this depth is determined by first determining how much standing oil there is in the well. For example, if the top of the oil in the well is found to be at 1327 feet and the water/oil interface is at 2197 feet, then 870 feet of standing oil exits in the well. Below 2197 feet is water. Using this information, the pump is preferably placed in the oil so that only oil is pumped. By pumping at a faster than expected recovery rate, the amount of oil recovered will decrease to a constant amount once the oil above the pump has been pumped down. That constant amount will be the recovery rate for that well. Over time that rate is likely to change as mentioned above. Accordingly, it is preferred to set the recovery rate of the oil recovery device to a rate slightly higher than the determined recovery rate and to monitor the recovery rate over time. As the recovery rate increases or decreases, the recovery device can be tuned accordingly to make it more efficient. This can be accomplished by using the control module to increase/decrease the number of oil recovery cycles for the oil extractor or increasing/decreasing the time the pump jack is operated.

Figure 4:
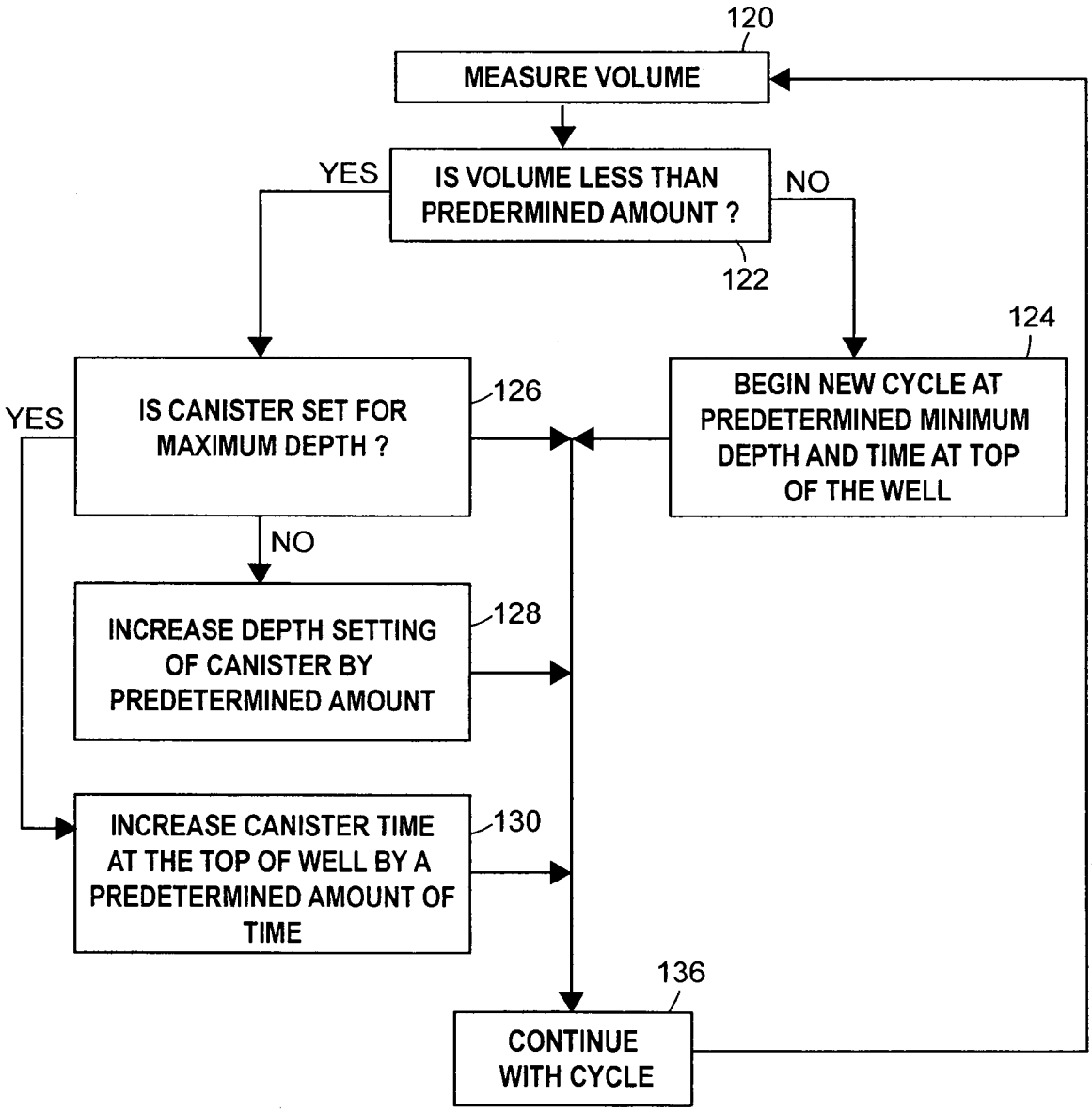
FIG. 4 is a flow diagram example for tuning a recovery cycle.

Automating the recovery device has other tuning advantages for optimizing the recovery process. For example, the extractor unit can be tuned to optimize its recovery rate as illustrated by the control flow diagram shown in FIG. 4. Increasing the chances that a full load is recovered with each cycle can optimize the extractor unit. For example, by measuring the amount of fluid recovered, as described above, the control module can lower the canister further into the well on the next cycle. If the volume is less than a predetermined amount, then the canister is lowered by a predetermined amount in the well, steps 120, 122, and 124. Preferably, a determination is made as to whether the canister is at a maximum level so that it retrieves only oil, step 126. If not then the control module will lower the canister by a predetermined amount to ensure that the next load is full, step 128. If the level of the canister has already reached the maximum level, the time that the canister is at the top of the well can be increased to account for the recovery time of the well when a less than predetermined load is detected, step 136. Avoiding partial load saves time and energy.

Similarly, as would be appreciated by those skilled in the art, a pump jack can be more efficient if a meter is used to determine the amount of fluid recovered and timing its operations to optimize recovery.

Communication Networking

Figure 5:
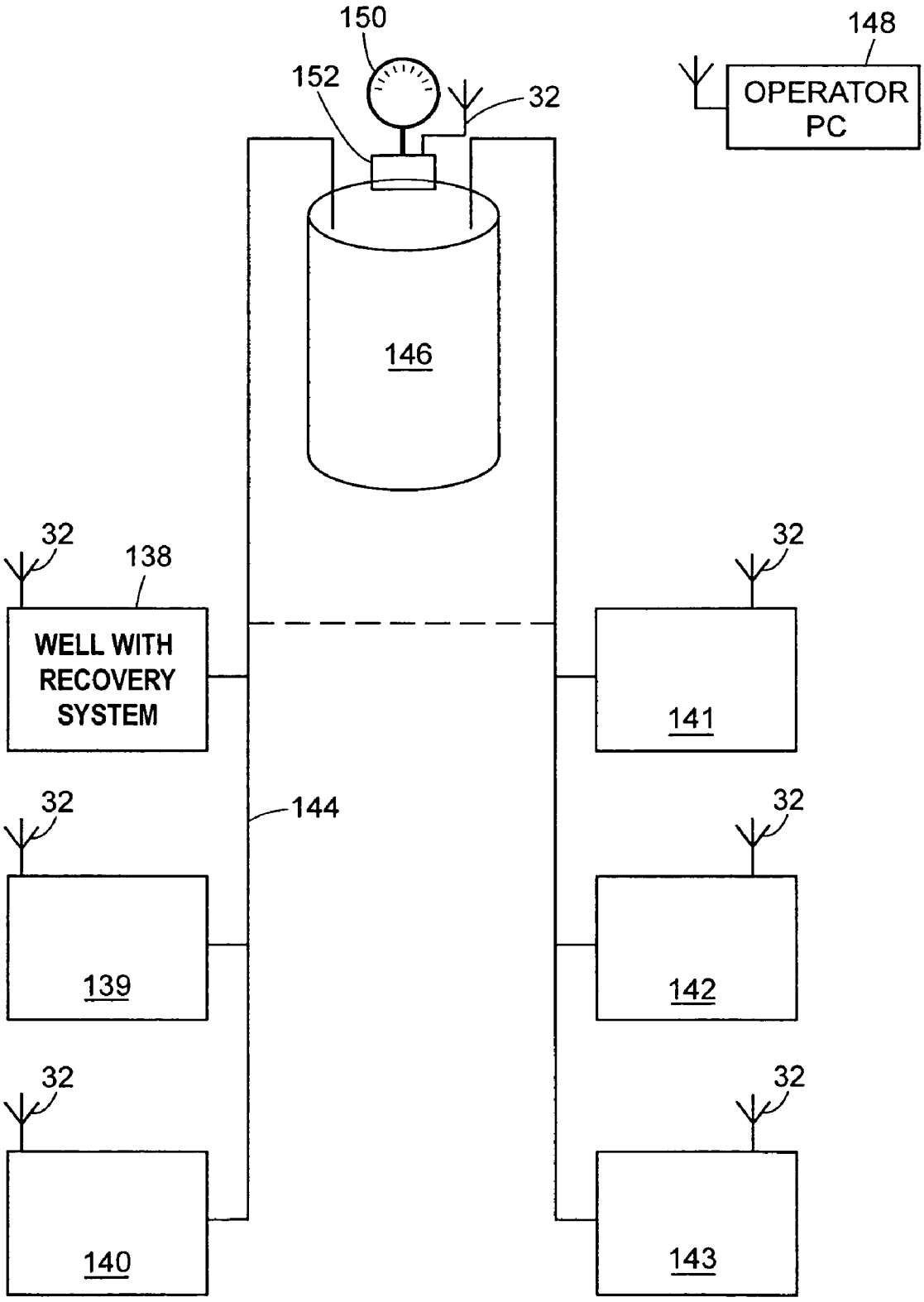
FIG. 5 is a schematic diagram used to illustrate a system of recovery devices connected to a storage tank.

Typically an operator in the oil fields manages leases with several oil wells. In accordance with the teachings of the present disclosure, preferably each well is equipped with a well recovery system described above (138-143) as illustrated in FIG. 5. As one skilled would appreciate, often these fields are in remote and not easily accessible areas. At the surface of each well, a series of flow lines/pipes 144 is often used for enabling the recovery devices at each well to pump fluid to one or more storage tanks 146. In some cases, a storage tank may be assigned to only one well (not shown). To effectively manage these wells, in addition to automating the recovery device as described above it is preferred that each recovery device be equipped with a two-way wireless communication device 32 for creating a communication network to enable data collected at each well to transmitted to an operator's computer 148. For example a wavecom modem can be connected directly to the control module to enable wireless cellular communication to each recovery device. Alternatively, a two-way radio is connected directly to the control module and enables radio communication to each recovery device. Radios having a radius of communication between 5 to 10 miles are commonly available, relatively in expensive, and particularly suited for this application. Using this data, the operator can remotely monitor or control each recovery device as necessary, thereby avoiding time-consuming trips to monitor and control the wells. It is also preferred that the storage tank 146 be equipped with a two-way wireless communication device 32 and a meter 150 that measures the fluid level in the tank 146. A control module 152, similar to that one shown and described with reference to FIG. 1 above could be used to operate the communications device 32 and the meter 150 from the tank. Benefits of putting a control module on the tank include notifying the operator or owner of the level of the fluid in the tank to prevent over flow and to schedule pickups at desired times. In potential overflow conditions, the control module could be programmed to shut down the pumps feeding into the tank. Placing a control module at the tank also provides the opportunity to make that control module the master device for communication to the operator (as will be described in more detail below) since the tank may be more likely to be located in a place, facilitating dial up telephone line connection as an alternative to wireless cellular connection.

In one embodiment, each recovery system is preferably equipped with a radio transmitter or cellular communications as described above that would enable communications back and forth between the operator and each recovery device. Radio transmitters and cellular communications equipment for this purpose are commonly available. Wireless web technology is also available. For example, Aeris.net of San Jose Calif. offers products that provide two-way wireless connectivity and control of remote intelligent devices.

In an alternate embodiment, the one recovery device could be designated as a master recovery device for communication with the operator. The remaining recovery devices would be designated as "slave" recovery devices that communicate with the operator through the master recovery device. In some cases, because of the remoteness of some of the wells, the radio transmitters could be configured to use other radio transmitters located on closer recovery devices to communicate with a more remote master recovery device. In other words, the transmission of data from one slave recovery device may use another slave recovery device (known as a repeater) to communicate with the master recovery device if it is not close enough to directly communicate with it. The master recovery device would preferably have cellular communications for remotely communicating with the operator anywhere in the world.

The type of information that would be useful to the operator includes information for monitoring the operation of the devices, for metering the amount of oil as it is being produced at each well, and for performing diagnostics for each device and/or system of devices (including performance of various components of the device, the device as a whole, or communications with the devices). Data could be automatically stored by the control module and thereafter automatically sent to an operator or upon the operator's request. Based on this information, the operator or user would then be able to change the operating instructions, such as change the recycle recovery time as described above, raise or lower the canister in the well, reset the depth of the canister, or shut down the recovery system for service repairs. Similarly a business plan could also be developed for recovering oil at each well and charging for those services based on the amount of oil recovered at that well or by leasing such a recovery system at each well. A service business plan could also be developed for maintaining the operation of the devices or the oil field as a whole. For example, by being able to meter the amount of oil recovered at each well, a business method could be developed for leasing the oil extractor and charging only for the amount of oil recovered at that well by that extractor. Production rates, histories, invoices, etc. could then be sent electronically to the well owner/operator. Further, using web browser technology, the owner/operator of the well or oil/gas field could view the operation of the various devices remotely, without interfering with the operations.

Diagnostics

By providing a communications network described above, there are several types of diagnostic routines that can be preformed both at the device. The results of these diagnostic routines can be automatically transmitted to the owner/operator by the control module to either the remote operator's computer or to an operators cell phone (not shown), allowing for quick responses. Preferably, the operator's cellular phone is configured to send requests or commands to the recovery devices. Alternatively these results can be sent upon request by the owner/operator communicating with the devices. A few of the possible diagnostic routines that could be preformed by the control module will be described below. However, is should be clear to one skilled in the art that several other diagnostic routines could be created to evaluate the performance of the recovery device, the recovery system, or the communications to the devices.

One important diagnostic is to test for leaks in the lines 144 (FIG. 5) connecting the oil recovery system 11 to the storage tank 146. Often leaks occur in these lines and there is no way of finding these leaks until physical inspections reveal the spillage or environmental damage. With the present system, tests can now be preformed to test these lines by determining the metered amount of fluid pumped into the lines by the various recovery devices and then comparing that amount to the amounts received in the tank. By controlling the recovery device, the flow pattern in each line can be controlled and a determination of the health of the flow line connecting each recovery device to the tank can be determined. For example, in succession all but one of the recovery devices could be turned off. The amount of fluid pumped by that recovery device could then be compared to that amount received at the tank using the level meter 108. Other combinations of pumping by the devices and measuring the amount received by the tank could also be done.

Another preferred diagnostic test includes testing the accuracy of the meter. If a business charges for fluid pumped at the wells, reliability and accuracy of the meters are critical. There are several ways to test the meter. One way is to test the meter reading at the recovery device and compare it to the amount received at the tank as indicated by the level meter 150 at the tank. Since it is preferred that each metered amount is time stamped at the well, providing a time stamp of when fluid is received and the amount received can be used to determine relative accuracy of the meter at the well. Another way to verify the accuracy of the metering system is to put a three-way valve (not shown) between the meter and the line 144 used to deliver the fluid to the tank. The T-valve would allow a field operator or recovery device inspector to randomly test the amount of fluid measured by the meter and compare it against the time stamped amounts recorded, much in the same way gas pumps at gas stations are monitored.

Other diagnostic tests that would be important include the operation of the recovery device, such as monitoring the well being of the motor used to operate the recovery device and the compressor of the oil extractor. One test that could be preformed by the controller or by the operator collecting data from the recovery device could include comparing the history of the up/down time of the canister for the oil extractor device or the number of pumping cycles of the pump jack. A slow down in either would indicate a drag on the system, which could mean motor fatigue. Tests could be performed to test the operation of the compressor for the oil extractor by measuring the pressure build up in the tank meter with the vent and drain closed. Monitoring and determining increasing pressures needed to drain the canister and the meter tank could be symptomatic of pressure leaks. Other diagnostics would include detecting the motor load to detect fluid pounding for pump jacks or when the top of the fluid is reached by the canister of the oil extractor for determining the level of fluid in the well. This information could also be used to tune the recover of the recovery system.

It should be understood by one skilled in the art that several modifications to the system disclosed above could be made without departing from the spirit and scope of the present invention. For example, there are various types of controllers and communication devices available in the market that could be configured to operate in accordance with the teachings described above. The number of I/Os needed to make digital or analog connections will vary depending on the recovery device that is used and the type of data to be collected. For example, sensors could be placed on the pump jack to detect the motion of the rocker arm for detecting if the rod break, detect if the cable or belt between the pump and the motor fail, etc. Further, the control module could be independently powered by solar or battery supplies or be connected to available power lines. A battery backup system could also be provided to protect the settings and stored data of the recovery system. Diagnostics described above as well as other diagnostics could be done at the control module and results sent to an operator or performed by the operator remotely from the recovery system. Alarms and alerts could be built into the system to warn the operator of certain events. Other benefits and options could be built into the above-described system and should become apparent in view of the teachings above.

Although certain apparatus constructed in accordance with the teachings of the invention have been described herein, the scope of coverage of this patent is not limited thereto. On the contrary, this patent covers all apparatuses, methods and articles of manufacture of the teachings of the invention fairly falling within the scope of the appended claims either literally or under the doctrine of equivalents.

In view of the above discussion I claim:

1. A wireless communication network for a remote process control system having distributed process control functions performed at sub-systems of the process control system, the network comprising:

a. a plurality of field devices, wherein each of the plurality of field devices is included in a respective sub-system of the process control system to perform a physical operation in a field;

b. a plurality of meters, wherein each of the plurality of meters is included in a respective sub-system of the process control system to measure a parameter of the physical operation performed by the respective one of the plurality of field devices;

c. a plurality of modules, each control module controlling the operation of a respective one of the plurality of field devices in one of the sub-systems of the process control system, wherein one control module is designated a master communicator and the remaining control modules are designated slave communicators, d. a radio frequency communications module connected to each of the control modules for remotely transmitting and receiving information regarding its sub-system, wherein the designated slave communicators transmit process information to and receive process information from the master communicator, e. a cellular communications module connected to the master communicator for (i) remotely transmitting sub-system process information including measurement or diagnostic data, received from the slave and master communicators, using cellular communication technology, and (ii) receiving sub-system process information for the sub-systems using cellular communication technology, and f. an operator computer communicating with the master communicator using cellular communication technology to transmit sub-system process information to and receive sub-system process information from the master communicator, wherein the sub-system process information transmitted to the master communicator from the operator computer includes information for controlling the operation of the control modules and the corresponding field devices of the process control system.

2. The wireless communication network of claim 1 wherein the remote process control system is an oil field and the sub-systems are oil recovery devices.

3. The wireless communication network of claim 1 wherein at least one slave communicator is a repeater device that receives radio frequency communications containing sub-system process information from another of the slave communicators and transmits radio frequency communications containing the sub-system process information to the master communicator.

4. The wireless communication network of claim 1 wherein the control modules are configured to operate the corresponding sub-systems for a first operational cycle, to determine an optimal operating condition for the sub-system based on the operation of the sub-system during the first operational cycle, and to operation the sub-system according to the determined optimal operating condition during a second operational cycle.

5. The wireless communication network of claim 1 wherein the control modules are configured to detect error conditions in the operations of the corresponding sub-systems, and to stop the operations of the sub-systems in response to detecting error conditions.

6. The wireless communication network of claim 5 wherein the control modules of the slave communicators are configured to cause the corresponding radio frequency communications modules to transmit messages containing information regarding the detected error conditions to the master communicator, and wherein the control module of the master communicator is configured to cause the corresponding cellular communications module to transmit the error condition messages to the operator computer.

7. The wireless communication network of claim 6 wherein the operator computer is configured to transmit instruction messages with instructions for the slave communicators to operate in response to the detected error conditions to the master communicator using cellular communication technology, wherein the master communicator is configured to receive the instruction messages from the operator computer and to cause the corresponding radio frequency communications module to transmit the instruction messages to the corresponding slave communicators, and wherein the slave communicators are configured to cause the corresponding sub-systems to operate in accordance with the instructions of received instruction messages.

8. A wireless communication network for a remote process control system having distributed process control functions performed at sub-systems of the process control system, wherein each of the sub-systems includes a field device to perform a physical operation in a field and a meter to measure a parameter of the physical operation, the network comprising:

a. a plurality of control modules, each control module being associated with one of the subsystems of the process control system, and at least one control module controlling the operation of the corresponding field device, wherein one control module is designated a master communicator and the remaining control modules are designated slave communicators, b. a radio frequency communications module connected to each of the control modules for remotely transmitting and receiving information regarding its sub-system, wherein the designated slave communicators transmit process information to and receive process information from the master communicator, c. a cellular communications module connected to the master communicator for remotely transmitting and receiving sub-system process information from the slave and master communicators remotely using cellular communication technology, and d. an operator computer communicating with the master communicator using cellular communication technology to transmit sub-system process information to and receive sub-system process information from the master communicator, wherein the sub-system process information transmitted to the master communicator from the operator computer includes information for controlling the operation of the control modules and the corresponding sub-systems of the process control system.

9. The wireless communication network of claim 8 wherein the remote process control system is an oil field and the sub-systems are oil recovery devices.

10. The wireless communication network of claim 8 wherein at least one slave communicator is a repeater device that receives radio frequency communications containing sub-system process information from another of the slave communicators and transmits radio frequency communications containing the sub-system process information to the master communicator.

11. The wireless communication network of claim 8 wherein the control modules controlling the operations of the corresponding sub-systems are configured to operate the sub-systems for a first operational cycle, to determine an optimal operating condition for the sub-system based on the operation of the sub-system during the first operational cycle, and to operation the sub-system according to the determined optimal operating condition during a second operational cycle.

12. The wireless communication network of claim 8 wherein the control modules controlling the operation of the corresponding sub-systems are configured to detect error conditions in the operations of the sub-systems, and to stop the operations of the sub-systems in response to detecting error conditions.

13. The wireless communication network of claim 12 wherein the control modules of the slave communicators are configured to cause the corresponding radio frequency communications modules to transmit messages containing information regarding the detected error conditions to the master communicator, and wherein the control module of the master communicator is configured to cause the corresponding cellular communications module to transmit the error condition messages to the operator computer.

14. The wireless communication network of claim 13 wherein the operator computer is configured to transmit instruction messages with instructions for the slave communicators to operate in response to the detected error conditions to the master communicator using cellular communication technology, wherein the master communicator is configured to receive the instruction messages from the operator computer and to cause the corresponding radio frequency communications module to transmit the instruction messages to the corresponding slave communicators, and wherein the slave communicators are configured to cause the corresponding sub-systems to operate in accordance with the instructions of received instruction messages.

15. A wireless communication network for a remote process control system having distributed process control functions performed at sub-systems of the process control system, the network comprising:

a. a plurality of modules, each control module controlling the operation of one of the sub-systems of the process control system, wherein one control module is designated a master communicator and the remaining control modules are designated slave communicators, b. a radio frequency communications module connected to each of the control modules for remotely transmitting and receiving information regarding its sub-system, wherein the designated slave communicators transmit process information to and receive process information from the master communicator, c. a cellular communications module connected to the master communicator for remotely transmitting and receiving sub-system process information from the slave and master communicators remotely using cellular communication technology, and d. an operator computer communicating with the master communicator using cellular communication technology to transmit sub-system process information to and receive sub-system process information from the master communicator, wherein the sub-system process information transmitted to the master communicator from the operator computer includes information for controlling the operation of the control modules and the corresponding sub-systems of the process control system, wherein a sub-system having a slave communicator produces a product that is output to the sub-system having the master communicator, wherein the control module of the sub-system having the slave communicator measures the amount of the product output to the sub-system having the master communicator and causes the corresponding radio frequency communications module to transmit a message to the radio frequency communications module of the master communicator with the measured output amount of the product, wherein the control module of the sub-system having the master communicator measures the amount of the product received from the sub-system having the slave communicator, compares the measured received amount of the product to the measured output amount of the product from the message from the slave communicator, and determines that an error condition exists where the amount received at the sub-system having the master communicator is not equal to the amount output by the sub-system having the slave communicator.

16. A wireless communication network for a remote process control system having distributed process control functions performed at sub-systems of the process control system, the network comprising:

a. a plurality of control modules, each control module being associated with one of the subsystems of the process control system, and at least one control module controlling the operation of the corresponding sub-system, wherein one control module is designated a master communicator and the remaining control modules are designated slave communicators, b. a radio frequency communications module connected to each of the control modules for remotely transmitting and receiving information regarding its sub-system, wherein the designated slave communicators transmit process information to and receive process information from the master communicator, c. a cellular communications module connected to the master communicator for remotely transmitting and receiving sub-system process information from the slave and master communicators, remotely using cellular communication technology, and d. an operator computer communicating with the master communicator using cellular communication technology to transmit sub-system process information to and receive sub-system process information from the master communicator, wherein the sub-system process information transmitted to the master communicator from the operator computer includes information for controlling the operation of the control modules and the corresponding sub-systems of the process control system, wherein a sub-system having a slave communicator produces a product that is output to the sub-system having the master communicator, wherein the control module of the sub-system having the slave communicator measures the amount of the product output to the sub-system having the master communicator and causes the corresponding radio frequency communications module to transmit a message to the radio frequency communications module of the master communicator with the measured output amount of the product, wherein the control module of the sub-system having the master communicator measures the amount of the product received from the sub-system having the slave communicator, compares the measured received amount of the product to the measured output amount of the product from the message from the slave communicator, and determines that an error condition exists where the amount received at the sub-system having the master communicator is not equal to the amount output by the sub-system having the slave communicator.

* * * * *

UNITED STATES PATENT AND TRADEMARK OFFICE

CERTIFICATE OF CORRECTION

PATENT NO. : 7,878,250 B2
APPLICATION NO. : 11/232567
DATED : February 1, 2011
INVENTOR(S) : Michael L. Sheldon It is certified that error appears in the above-identified patent and that said Letters Patent is hereby corrected as shown below:

In the Specification:

At Column 3, line 6, “stand alone” should be -- standalone --.

At Column 5, line 33, “back up” should be -- backup --.

At Column 9, line 25, “back up” should be -- backup --.

At Column 13, lines 35-36, “preformed” should be -- performed --.

At Column 14, lines 13-14, “preformed” should be -- performed --.

At Column 14, lines 17-18, “slow down” should be -- slowdown --.

At Column 14, line 29, “recover” should be -- recovery --.

In the Claims:

At Column 17, line 1, “operation” should be -- operate --.

Signed and Sealed this
Eleventh Day of October, 2011

David J. Kappos

David J. Kappos
*Director of the United States Patent and Trademark Office*